US006213066B1

(12) United States Patent
Dahlberg et al.

(10) Patent No.: US 6,213,066 B1
(45) Date of Patent: Apr. 10, 2001

(54) DRIVE UNIT

(75) Inventors: Göran Dahlberg, Gränna; Magnus Fröjd, Huskvarna; Niels Hartz, Huskvarna; Ulf Näslund, Huskvarna, all of (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/155,813

(22) PCT Filed: Apr. 4, 1997

(86) PCT No.: PCT/SE97/00571

§ 371 Date: Mar. 15, 1999

§ 102(e) Date: Mar. 15, 1999

(87) PCT Pub. No.: WO97/38216

PCT Pub. Date: Oct. 16, 1997

(30) Foreign Application Priority Data

Apr. 4, 1996 (SE) ..... 9601312

(51) Int. Cl.[7] ..... F02B 33/04

(52) U.S. Cl. ..... 123/73 A; 123/184.23; 123/543

(58) Field of Search ..... 123/65 P, 65 A, 123/73 R, 73 PP, 73 A, 184.22, 184.23, 543

(56) References Cited

U.S. PATENT DOCUMENTS 4,607,598 * 8/1986 Kamata ..... 123/65 P
5,699,761 * 12/1997 Yamaguchi et al. ..... 123/65 P

FOREIGN PATENT DOCUMENTS 70531 4/1983 (AU) .
3916414 1/1991 (DE) .
2911497 2/1991 (DE) .

* cited by examiner

*Primary Examiner*—Noah P. Kamen
(74) *Attorney, Agent, or Firm*—Pearne & Gordon LLP

(57) ABSTRACT

A drive unit (1) for a handheld working tool, such as a chain saw, trimmer or hedge trimmer, essentially comprising a housing part (2) with a fuel tank (3) and an engine unit (4) with a fuel supply unit (5) such as a carburetor (5), a muffler (6), and a crankcase scavenged combustion engine (7) with a cylinder (8), piston (15) and crankshaft. The engine (7) has at least one inlet port (9) located in the cylinder wall (10) of the engine and/or an adjacent part of the engine crankcase (11), and the engine's inlet duct (13) from the inlet port (9) up to the fuel supply unit (5) has a length longer than 1.8 times the engine cylinder stroke (18), preferably longer than 2.0 times the cylinder stroke (18).

16 Claims, 2 Drawing Sheets

DRIVE UNIT

TECHNICAL FIELD

The subject invention refers to a drive unit for a handheld working tool, such as a chainsaw, trimmer or hedge trimmer, said drive unit essentially comprises a housing part with a fuel tank and an engine unit with a fuel supply unit, such as a carburetor, a muffler and a crankcase scavenged combustion engine, with cylinder, piston and crankshaft.

BACKGROUND OF THE INVENTION

Due to requirements of low weight and compact design portable working tools are usually run by a crankcase scavenged two-stroke engine. However, a crankcase scavenged four-stroke engine is also conceivable. As a result of the crankcase scavenging, oil mixed with the fuel lubricates the engine. This means that the tool can be oriented in different directions while running, such as sideways or upside-down. The tools usually have a carburetor connected to an inlet duct, but also a low pressure injection system can be of interest. Since the tool can be used in a lot of positions there is a risk for fuel drops to accumulate inside the inlet duct and then be tipped into the cylinder when the tool's inclination is changed. This can bring about that the engine stops. The greatest risk for this is at lower engine speed. For this reason, the carburetor is usually placed near the inlet port resulting in a short inlet duct. Considering engine power at operating speed it would however be preferable to use a longer inlet duct. This could however be associated with said difficulties as well as pure space problems. Therefore the carburetor is usually adjacent the cylinder's top section, and provided With some kind of heat protecting baffle. This baffle implies a complication at the same time as temperature problems can still arise for the carburetor. Furthermore, the inlet duct usually turns obliquely downward towards the crankcase. Owing to this the inlet gases can not assist in cooling the critical area around the exhaust port.

PURPOSE OF THE INVENTION

The purpose of the subject invention is to substantially reduce the above outlined problems.

SUMMARY OF THE INVENTION

The above mentioned purpose is achieved in a drive unit, in accordance with the invention, having the characteristics appearing from the appended claims.

The drive unit according to, the invention is thus essentially characterized in that at least one inlet port is located in the engine cylinder wall and/or in an adjacent part of the engine crankcase, arid that the engine inlet duct from the inlet port up to the fuel supply unit has a length longer than 1.8 times the engine cylinder stroke, preferably longer than 2.0 times the cylinder stroke. The long inlet duct gives advantages but also implies a number of risks as mentioned above. It requires an elaborate drawing of the inlet duct so that the risk for fuel drops to accumulate in the inlet duct is reduced. Furthermore it is advantageous to have a long preheated section of the inlet duct, which vaporizes fuel drops and thus reduces said risks. By a suitable angling of the inlet duct a cooling effect can also be created around the cylinder's exhaust port and adjacent parts of the piston. These and other characteristic features and advantages of the invention will become apparent from the following detailed description of various embodiments with the support of the annexed drawing.

BRIEF DESCRIPTION OF THE DRAWING

The invention will be described in closer detail in the following by way of various embodiments thereof with reference to the accompanying drawing, in which the same numbers in the different figures state one another's corresponding parts. Alternative parts are designated by a sign' and are shown with phantom lines, e.g. handle 20' in FIG. 1 is an alternative to handle 20.

Figure 1:
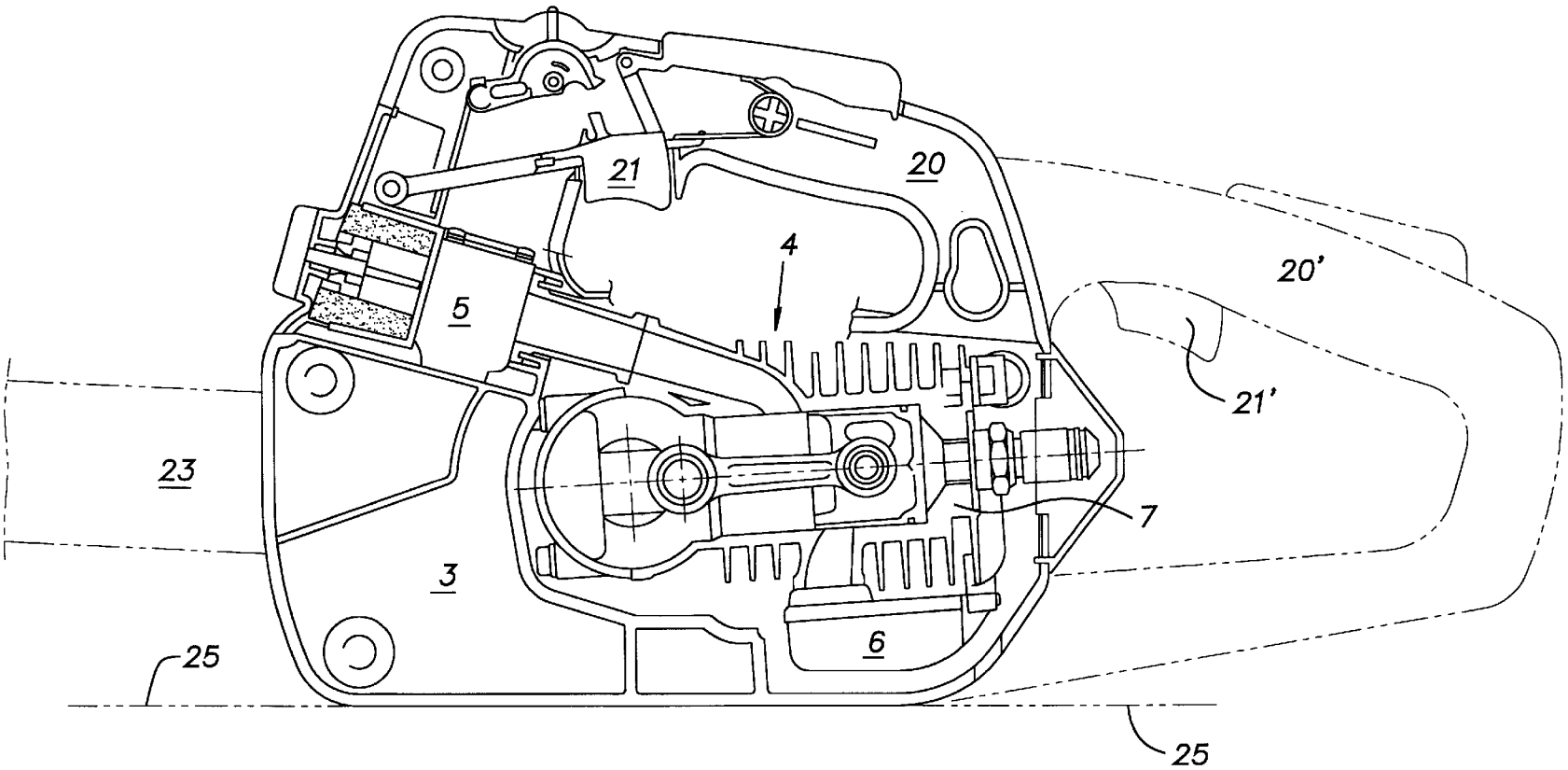
FIG. 1 shows a drive unit in accordance with the invention seen in a lateral cross-sectional view. In this case the drive unit is intended for a chainsaw, having a guide bar 23 shown in phantom. However, the drive unit can also be used for other applications, such as a hedge trimmer or trimmer.

In the schematic FIG. 1, reference numeral 1 designates a drive unit in accordance with the invention. The drive unit 1 is essentially composed of a housing part 2 with a fuel tank 3 and an engine unit 4. The engine unit 4 is composed of a crankcase scavenged combustion engine 7 with a fuel supply unit 5, such as a carburetor and a muffler 6. The drive unit 1 in the figure is intended for a chainsaw of so called "top-handle" model, where the handle is positioned on the top of the saw. This type of chainsaw is usually small and light-weight and is balanced to enable some cutting to be done while holding the saw with only one hand. The saw is held by the handle 20 which is provided with a throttle control 21 that can be controlled by the operator's finger.

However, the drive unit 1 can also be used for other applications. If the drive unit 1 is used for a so-called trimmer, the drive unit 1 is not mounted to a handle 20, but is instead mounted on a rig tube. In this case the control cables and/or electric cables extend from the handle to the drive unit 1, for control of engine speed and stop function. The rig tube extends parallel to a centerline 17 of the engine's crankshaft and perpendicular to the illustrated plane of the figure.

When starting the tool, usually with a starter rope, the tool is placed on the ground 25. The drive unit 1 can also be used for a chainsaw with conventional handles. Such kind of chainsaw has a rear handle 20' with throttle control 21' and a side handle (not shown). In that case the handle 20 is omitted. This kind of chainsaw should always be used, with two hands, which is recommendable from a safety point of view. In both cases the guide bar 23 with saw chain are arranged in a conventional way.

Figure 2:
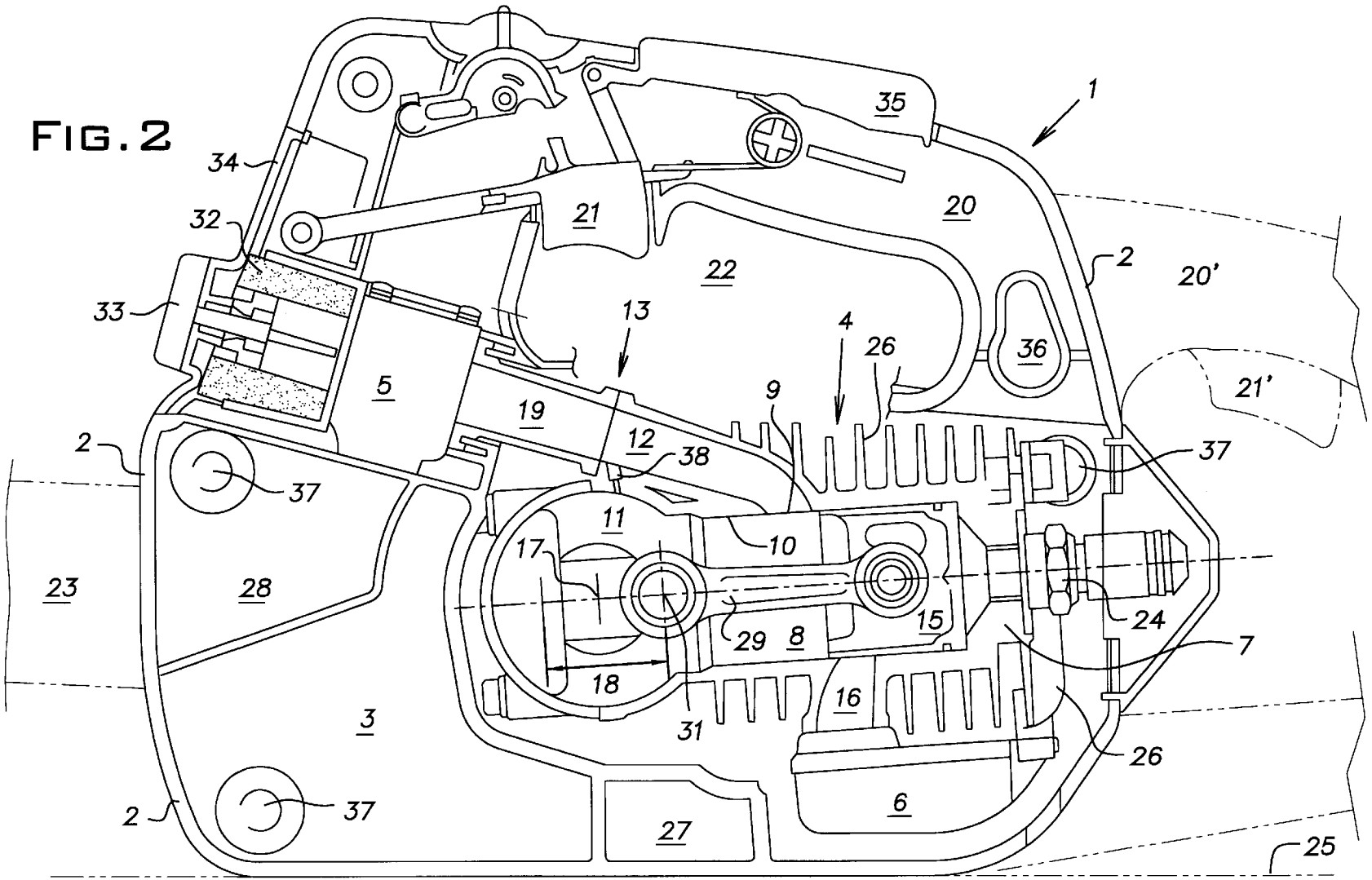
FIG. 2 is a partial enlargement of FIG. 1.

FIG. 2 shows the drive unit 1 enlarged. The engine unit 4 is attached to a housing part 2, which also comprise; handle 20 with throttle control 21. The engine unit 4 in question is a one-cylinder two-stroke engine, usually with a displacement between 25 and 100 cc. The engine unit 4 is air-cooled and therefore provided with a large number of cooling fins 26 and with a cooling fan (not shown). The engine unit 4 has a cylinder 8 with a piston 15 with a piston rod 29, which rotates the engine's crankshaft about its center 17. The engine unit 4 has an inlet port 9 with an associated inlet duct 13. Furthermore the engine has an exhaust port 16 with a directly mounted muffler 6. A spark plug 24 connects to the 30 for the cylinder 8 extends down through the crankshaft center 17. In this case crank pin center 31 is also located on the cylinder centerline 30. The distance between crankshaft center 17 and crank pin center 31 represents half of the engine's cylinder stroke 18, which is marked in the figure.

The engine has an extremely long inlet duct 13. This creates opportunities for increasing the engine's traction power at normal operating speed, and can give higher power and/or cleaner exhaust gases at operating speed. Due to increased throttling on the exhaust side, less exhaust emissions can be achieved while retaining power. The reason for this improvement is that a higher engine charging efficiency can be obtained at the present engine speed. This is achieved due to a more favorable Helmholz resonance frequency. The resonance frequency is determined essentially by the relation between the length of the inlet duct 13 and the crankcase volume, which is relatively well reflected by the cylinder stroke 18. From a calculation point of view the distance from an air filter 32 to the inlet port 9 is mostly representative as the length of the "inlet duct". However, it is also advantageous to place the air filter 32 adjacent the fuel supply unit 5 in order to reduce disturbances from pressure variations, so called "quarter-waves". Long inlet ducts are not being used for these drive units for several reasons. Obviously, a long inlet duct takes up a great deal of space which is critical for a handheld working tool considering its demand for being compact and low-weight. However, a more serious problem, when handling the tool, is the risk of engine stop, especially in connection with idling. This is because fuel drops accumulate in a long inlet duct. When handling the tool the result can be that fuel is being poured into the engine which then stops. However, it has turned out that these risk factors can be reduced by using a very elaborate shaping of the inlet duct's geometry and by using a long preheated section of the inlet duct. Normally the engine has an inlet port 9 located in the engine cylinder wall 10 and/or an adjacent part of the engine crankcase 11. This location creates conditions for an advantageous drawing of the inlet duct 13. Preferably the opening and closing of the inlet port 9 is controlled by the movement of the piston 15, but the inlet duct 13 can also be provided with a so called reed valve. Preferably the inlet duct 13 from the inlet port 9 on to the fuel supply unit 5, has a length longer than 1.8 times the engine cylinder stroke 18, preferably longer than 2.0 times the cylinder stroke 18.

The inlet duct 13 has a long preheated end section 12. Fuel drops can hereby be vaporized in this section, so that a homogeneity of the fuel mixture can be achieved. The end section 12 is arranged to form a fixed and heat conducting part of the cylinder 8 and has preferably a length longer than 0.8 times the engine cylinder stroke 18, preferably longer than 1.0 times the cylinder stroke 18. Preferably the end section 12 is cast in one piece together with the cylinder 8, but the end section 12 can also comprise a firmly mounted tube.

As appears from the figure inlet duct 13 is directed towards the cylinder's top section with the combustion chamber 14. Otherwise these tools' inlet ducts normally have an opposite inclination, sloping down towards the crankcase 11. This can provide a somewhat lower inflow resistance. The advantage of having the direction towards the cylinder's top section is that the inflowing gases are cooling the piston 15 and the cylinder wall 10 at the engine exhaust port 16. Hereby the risk of engine seizure is reduced. In the present application the cylinder 8 is almost completely lying down and the inlet duct 13 has a strong inclination in relation to the cylinder's centerline 30. However, the cooling effect can also be achieved at less inclination. The determining fact is that the end section 12 of the engine inlet duct 13 up to the inlet port 9 differs from a perpendicular direction in relation to the cylinder's axial extension and is directed more towards the exhaust port 16 and combustion chamber 14 of the cylinder 8. Then the inlet gases will be deflected, either towards the piston 15 or towards the cylinder wall 10, and thus create the desired cooling effect.

As mentioned, the drive unit 1 in accordance with the invention, can be used both for a working tool with a vertical crankshaft, such as a hedge trimmer, or for a tool with a horizontal crankshaft. The orientation is then related to when the tool is placed on horizontal ground 25. In the shown embodiment crankshaft 17 is essentially horizontal and the cylinder 8 extends axially in an essentially horizontal direction, where the crankshaft centerline 17 inclines more than 45 degrees in relation to a vertical line, and the inlet duct 13 and the fuel supply unit 5 are essentially located on top of the cylinder 8, being above a plane which extends through the crankshaft center 17 and the cylinder center 30. The location of the fuel supply unit 5 and the drawing of the inlet duct 13 are of very great importance. In the present case the inlet duct 13 runs with an even inclination down towards the cylinder 8 where the inlet duct 13 bends and then slopes more steeply into the inlet port 9. When the tool is standing on plane ground 25 and at the same time is idling, some fuel drops inside the inlet duct 13 can thus flow down into the cylinder 8 all the time. This continuous supply is much more propitious than if a larger quantity would suddenly flow down. This could happen if the inlet duct 13 had a horizontal part where fuel could accumulate into a pool. When the user is lifting the tool up the pool can be released by another inclination and flow down into the tool causing engine stop. FIG. 2 shows a connection 38 in the end section 12. For the sake of clarity the connection 38 is only shown in the enlarged FIG. 2. Connection 38 communicates the inlet duct 13 with the crankcase 11, so that fuel drops can run from the inlet duct 13 to the crankcase 11. Hereby a certain improvement of the idling is achieved. Preferably the connection 38 has a collecting portion, which opens into the wall of the end section 12 and has a diameter of approximately 3 mm, and another portion, which opens into the crankcase 11 and has a smaller diameter of approximately 1 mm. Placing the connection 38 adjacent the outer mouth of the end section 12 will make it possible and easy to drill the holes through the mouth of the end section 12.

In the present case inlet duct 13 consists of both the propitious preheated end section 12 and an upstream part 19, which is associated with the end section 12 and continues on to the fuel supply unit 5. The upstream part 19 has an essentially smooth inner side. Otherwise it is more common to use folded rubber constructions for the upstream part 19 of the inlet duct 13. This is because it is more common to use an anti-vibration carburetor. In that case the engine unit 4 is elastically suspended in the housing part 2 and the fuel supply unit 5 is mounted into the housing part 2 and the upstream part 19 of the inlet duct 13 is made of a compliant material, such as rubber. Hereby the engine itself moves while the carburetor and the drive unit 1 with handle 20 is vibrating much less. In the present case three elastic attachments 37 are used, usually steel springs for mounting of the combustion engine proper. The upstream part 19 is located adjacent the drive unit's movement center, which results in small movements in the part 19 and allows using a flat tube. The upstream part 19 thus continues essentially in the same direction as the end section 12 on to the fuel supply unit 5.

Hereby an even inclination down towards the cylinder 8 is created, and the cylinder 8 is lying substantially horizontal. The inlet duct 13 runs away from the top section of the cylinder 8 where commonly a spark plug 24 is located. The inlet port 9 is preferably located in the cylinder wall 10. This arrangement creates conditions, on the one hand for a long inlet duct 13 with a long preheated section 12, and on the other hand for an advantageous placing of the fuel supply unit 5.

Said fuel supply unit 5 will thus be situated far away from the warmest parts of the engine, which is an obvious advantage. An air filter 32 is connected to the fuel supply unit 5 with a some kind of quick fastener. In this case there is a screw handle 33 which fastens the air filter 32. The air filter 32 is located at one side of the drive unit 1, said side is essentially opposite to that side where the cylinder's top section is located. This makes it easy to change air filter 32 by loosing the screw handle 33 and a protective cover 34.

In the shown embodiment of the top handle saw, the cylinder 8 is almost lying down, such that the cylinder centerline 30 inclines less than 15 degrees in relation to the horizontal ground 25, which goes along the tool's under edge. Hereby the handle 20 with the throttle control 21 can be placed very close to and above the engine unit 4. The handle's longitudinal direction is essentially parallel with the centerline 30 of the cylinder 8. This enables a saw with good balance characteristics and a low total height. The handle 20 is located so far forward that the throttle control 21, where the user grips the handle 20, is essentially just above the crankshaft center 17, which contributes to the good balance. The fuel supply unit 5 is located in front of a recess 22 in the handle 20 further away from the cylinder's top section. This means that the long inlet duct 13 is not only contributing to a powerful engine, but also to that the handle 20 can be placed low down to give the tool a low total height. To be able to give throttle with the throttle control 21 a conventional safety catch 35 in the handle 20 must be pushed in. A lifting hole 36 is located in the rear part of the handle 20. By connecting a lifting strap to this lifting hole 36 the user can carry the chainsaw and still have both hands free. The guide bar 23 of the saw, with the saw chain, is directed essentially in the same direction as the fuel supply unit 5, away from the cylinder's top section. This also results in a special advantage when removing a saw which has got stuck in a tree. The elastically suspended engine unit 4 is then moving in a direction towards the fuel supply unit 5 and the rubber tube will be compressed instead of being pulled out or folded. This is advantageous as regards durability. In this case the housing part 2 has three tanks, one fuel tank 3 with an adherent expansion tank 27, and one chain oil tank 28. Naturally, the chain oil tank 28 is specific to chainsaw applications. One problem with the cylinder 8 being horizontal is that the muffler 6 ends up under the cylinder 8. This problem is reduced by the exhaust port 16 and the scavenging ducts (not shown) being tilted by 15 degrees from a vertical position. As a result, the muffler 6 is also tilted, giving the muffler 6 more space. In this embodiment, the inlet port 9 is also tilted by the same angle of 15 degrees. However it is not necessary for the inlet port 9 to be tilted at the same angle as the exhaust port 16, the scavenging ducts, and the muffler 6. The angle of tilt for the inlet port 9 can be larger or smaller. As best shown in FIG. 2, one of the crankcase 11 halves is integrated into the cylinder 8, and the end section 12 of the inlet duct 13 extends to the plane dividing between the crankcase 11 halves.

What is claimed is:

1. A drive unit (1) for a handheld working tool, said drive unit essentially comprises a housing part (2) with a fuel tank (3) and an engine unit (4) with a fuel supply unit (5), a muffler (6) and a crankcase scavenged combustion engine (7), with a cylinder (8), a piston (15) and a crankshaft with a center (17), wherein the engine (7) has a crankcase (11) and at least one inlet port (9) located in the engine cylinder wall (10), wherein an engine inlet duct (13) from the inlet port (9) up to the fuel supply unit (5) has a length longer than 1.8 times the engine cylinder stroke (18) and, wherein an end section (12) of the engine inlet duct (13) serves as a fixed heat conducting part, the end section (12) having a side portion that is directly adjacent to a wall of the cylinder (8) and the crankcase (11) and the end portion having a length longer than 0.8 times the engine cylinder stroke.

2. A drive unit (1) in accordance with claim 1, wherein when the tool is placed on horizontal ground the crankshaft (17) is essentially horizontal and the cylinder (8) has an essentially horizontal axial extension, and the inlet duct (13) and fuel supply unit (5) are essentially located on top of the cylinder (8).

3. A drive unit (1) in accordance with claim 2, wherein a handle (20) with a throttle control (21) is located above the engine unit (4) so that the longitudinal direction of the handle is essentially parallel with the centre line (30) of the cylinder.

4. A drive unit (1) according to claim 3, wherein the throttle handle (21) is located essentially just above the crankshaft centre (17).

5. A drive unit (1) in accordance with claim 2, wherein, in a chain saw application, the guide bar (23) of the saw, with the saw chain, is directed essentially in the same direction as the fuel supply unit (5), i.e. away from the cylinder top section.

6. A drive unit (1) in accordance with claim 1, wherein an upstream part (19) of the engine inlet duct (13) is associated with the end section (12) and continues on to the fuel supply unit (5).

7. A drive unit (1) in accordance with claim 6, wherein the engine unit (4) is elastically suspended in the housing part (2) and the fuel supply unit (5) is mounted in the housing part, and in that the upstream part (19) of the engine inlet duct (13) is made of a compliant material.

8. A drive unit (1) according to claim 7, wherein the upstream part (19) has an essentially smooth inner side.

9. A drive unit (1) in accordance with claim 8, wherein the upstream part (19) continues essentially in the same direction as the end section (12) up to the fuel supply unit (5), which is located at one side of the drive unit (1), said side is essentially opposite to that side of the drive unit where the cylinder top section, commonly with a spark plug (24), is located.

10. A drive unit (1) in accordance with claim 7, wherein the upstream part (19) continues essentially in the same direction as the end section (12) up to the fuel supply unit (5), which is located at one side of the drive unit (1), said side is essentially opposite to that side of the drive unit where the cylinder top section, commonly with a spark plug (24), is located.

11. A drive unit (1) in accordance with claim 6, wherein the upstream part (19) continues essentially in the same direction as the end section (12) up to the fuel supply unit (5), which is located at one side of the drive unit (1), said side is essentially opposite to that side of the drive unit where the cylinder top section, commonly with a spark plug (24), is located.

12. A drive unit (1) in accordance with claim 1, wherein the inlet port (9) is located in the cylinder wall (10) and wherein opening and closing of the inlet port is controlled by movement of the piston (15).

13. A drive unit (1) in accordance with claim 1, wherein an engine inlet duct (13) from the inlet port (9) up to the fuel supply unit (5) has a length longer than 2.0 times the engine cylinder stroke (18).

14. A drive unit (1) according to claim 1, wherein an end section (12) of the engine inlet duct (13) forms a fixed heat conducting part of the cylinder (8) and has a length longer than 1.0 times the engine cylinder stroke.

15. A drive unit (1) for a handheld working tool, said drive unit essentially comprises a housing part (2) with a fuel tank (3) and an engine unit (4) with a fuel supply unit (5), a muffler (6) and a crankcase scavenged combustion engine (7), with a cylinder (8), a piston (15) and a crankshaft with a center (17); wherein the engine (7) has at least one inlet port (9) located in the engine cylinder wall (10); wherein an engine inlet duct (13) from the inlet port (9) up to the fuel supply unit (5) has a length longer than 1.8 times the engine cylinder stroke (18); wherein an end section (12) of the engine inlet duct (13) forms a fixed heat conducting part of the cylinder (8) and has a length longer than 0.8 times the engine cylinder stroke; and wherein the end section (12) of the engine inlet duct (13) up to the inlet port (9) differs from a perpendicular direction in relation to the cylinder axial extension, and is directed more towards the exhaust port (16) and combustion chamber (14) of the cylinder, whereby the piston (15) and the cylinder wall (10) at the engine exhaust port (16) will be cooled.

16. A drive unit (1) for a handheld working tool, said drive unit essentially comprises a housing part (2) with a fuel tank (3) and an engine unit (4) with a fuel supply unit (5), a muffler (6) and a crankcase scavenged combustion engine (7), with a cylinder (8), a piston (15) and a crankshaft with a center (17), wherein the engine (7) has at least one inlet port (9) located in the engine cylinder wall (10) and wherein an engine inlet duct (13) from the inlet port (9) up to the fuel supply unit (5) has a length longer than 1.8 times the engine cylinder stroke (18); wherein when the tool is placed on horizontal ground the crankshaft (17) is essentially horizontal and the cylinder (8) has an essentially horizontal axial extension, and the inlet duct (13) and fuel supply unit (5) are essentially located on top of the cylinder (8); wherein a handle (20) with a throttle control (21) is located above the engine unit (4) so that the longitudinal direction of the handle is essentially parallel with the center line (30) of the cylinder; wherein the throttle handle (21) is located essentially just above the crankshaft center (17); and wherein the fuel supply unit (5) is located in front of a recess (22) in the handle (20).

* * * * *